United States Patent [19]

Johnsen et al.

[11] 4,163,470

[45] Aug. 7, 1979

[54] INDUSTRIAL TECHNIQUE

[75] Inventors: Arne A. Johnsen, Barberton; Chandrasekhara R. Kakarala, Clinton, both of Ohio

[73] Assignee: The Babcock & Wilcox Company, New York, N.Y.

[21] Appl. No.: 812,015

[22] Filed: Jun. 30, 1977

[51] Int. Cl.[2] ..... F28F 9/00

[52] U.S. Cl. ..... 165/70; 122/32; 165/96; 165/160; 165/163; 176/38; 165/134 R

[58] Field of Search ..... 165/134, 160, 11, 70, 165/95, 96, 163; 122/32; 176/38

[56] References Cited

U.S. PATENT DOCUMENTS

| | | | |
|---|---|---|---|
| 3,085,626 | 4/1963 | Bognar et al. | 165/70 |
| 3,547,188 | 12/1970 | Kuhnlein | 165/134 |
| 3,557,760 | 1/1971 | Romanos et al. | 122/32 |
| 3,670,810 | 6/1972 | Allen, Sr. | 165/70 |
| 3,768,554 | 10/1973 | Stahl | 165/134 |
| 3,913,531 | 10/1975 | von Hollen | 122/32 |

*Primary Examiner*—Charles J. Myhre
*Assistant Examiner*—Sheldon Richter
*Attorney, Agent, or Firm*—J. M. Maguire; J. P. Sinnott

[57] ABSTRACT

An illustrative embodiment of the invention has a group of three concentrically disposed banks of helical steam generator tubes. Shrouds interposed between each of these three tube banks establish liquid barriers between the individual banks that prevent liquid sodium (or other shell side working fluid) from enjoying free communication throughout all of the tube banks. In this way, potentially damaging leakage between the shell side working fluid and the water within one of the tube banks can be isolated through discontinuation of the shell side working fluid and feedwater flow to the leaking bank, thereby permitting the remaining sound tube banks to continue functioning.

4 Claims, 1 Drawing Figure

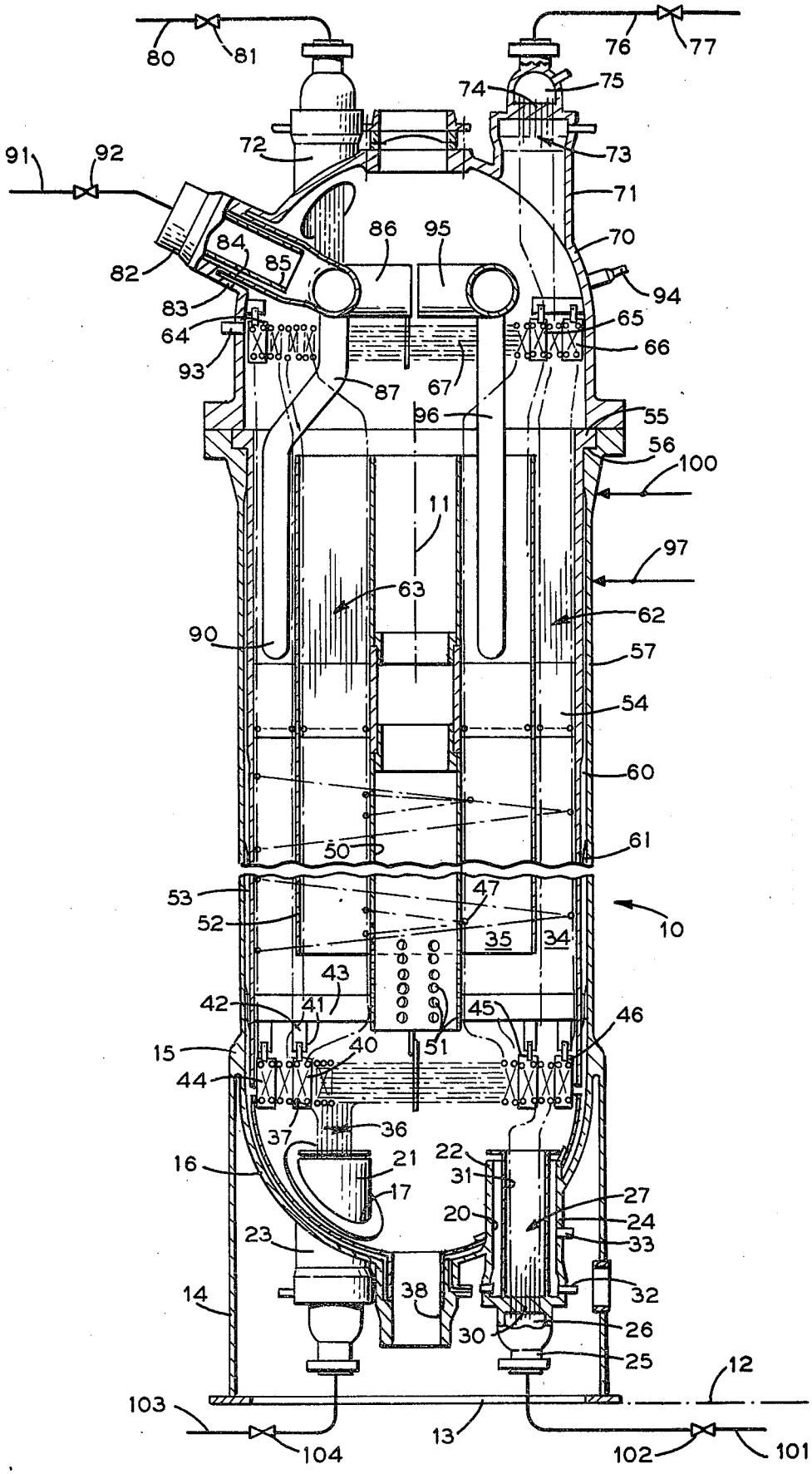
80
81
76
77
74
75
72
73
91
92
71
86
95
70
84
85
82
94
83
65
64
66
93
87
67
96
55
56
100
11
97
63
62
90
57
54
60
50
61
53
47
52
10
35
34
43
42
41
45
46
15
40
51
44
37
36
16
21
22
31
17
27
20
24
23
33
14
38
32
30
26
25
12
103
13
104
102
101

INDUSTRIAL TECHNIQUE

BACKGROUND OF THE INVENTION

1. Field of the Invention

This invention relates to heat exchangers for nuclear reactor systems and, more particularly, to sodium-to-water heat exchangers for liquid metal fast breeder reactors, and the like.

2. Description of the Prior Art

Many industrial processes require apparatus that enables heat to be transferred from one fluid to another. Frequently, these heat exchangers must permit this transfer to take place between fluids that are quite incompatible in one or more ways.

Typically, in a liquid metal fast breeder nuclear power reactor, it is necessary to transfer heat from molten sodium to water in order to generate steam for subsequent use in driving the turbines and associated generators that produce electricity. If the sodium and the water are permitted to mix together, even in relatively minute quantities, there will be a violent chemical reaction which will generate heat, gas and corrosive matter in the vicinity of the leak. An occurrence of this nature, if it is not observed and checked at an early stage, can cause a great deal of damage to the entire heat exchanger structure, or at the very least, it can compel the entire plant to remain idle while an otherwise minor leak is being repaired-an expensive and inefficient state of affairs.

A number of proposals have been advanced to overcome this problem. Illustratively, several heat exchangers, all connected in a manner that enables the water flow to any one of the heat exchangers to be stopped without interferring with the flow of water to any of the other heat exchangers in the event of a leak in any unit has been suggested. The large numbers of small units required in these circumstances, however, impose a significant increase in the cost of the steam generators and other associated power plant systems components.

Several types of double-wall tubes also have been devised, for example, in which an intermediate fluid that does not react violently with either water or sodium fills the volume between the tube walls. This approach to solving the sodium to water heat exchanger leak problem is very expensive, the initial cost of a double wall tube heat exchanger being several times that of a comparable single wall tube heat exchanger.

Accordingly, there is a pressing industrial need to devise a reliable and relatively low-cost heat exchanger that permits heat to be transferred safely between incompatible fluids in spite of a minor leak in the heat exchanger structure.

SUMMARY OF THE INVENTION

These and other problems that have characterized the prior art are overcome, to a large extent through the practice of the invention. More specifically several banks of concentrically nested helically wound tubes in an heat exchanger are segregated from each other by means of shrouds that are interposed between the individual tube banks. The shrouds establish fluid barriers between the adjacent individual tube banks. Appropriate valves permit the flow of feedwater and liquid sodium to the tubes in each bank to be stopped on a selective basis in order to prevent further damage in the event of a local leak. In this manner, although an entire tube bank is taken out of service, the heat exchanger nevertheless can continue to function with the remaining tube banks that are segregated from the now inoperative failed bank.

In the foregoing manner, damage caused by mixing incompatible working fluids is arrested and the power plant may continue in operation until it is time for a regularly scheduled interruption in service for routine maintenance and repair except for a temporary shut down to identify the failed tube bundle. Segregating individual tube banks within one heat exchanger shell in the foregoing manner also reduces plant cost relative to the proposed system that would use a group of small heat exchangers, each individually deactivatable in the event of a failure in any one of the heat exchangers. There is, moreover, no need for the expensive double wall tube designs that also have been advanced to cope with the problem of leakage and incompatible heat exchanger fluids.

The various features of novelty which characterize the invention are pointed out with particularity in the claims annexed to and forming a part of this specification. For a better understanding of the invention, its operating advantages and specific objects attained by its use, reference should be had to the accompanying drawing and descriptive matter in which there is illustrated and described a preferred embodiment of the invention.

BRIEF DESCRIPTION OF THE DRAWING

The sole FIGURE of the drawing is a front elevation in full section of a heat exchanger that embodies principles of the invention.

DETAILED DESCRIPTION OF THE PREFERRED EMBODIMENTS

For a more complete appreciation of the invention, attention is invited to the drawing which shows a sodium-to-water heat exchanger 10. The heat exchanger 10 has a longitudinal axis 11 that is perpendicular to a foundation 12. As shown in the drawing, a support plate 13 is bolted or otherwise suitably secured to the foundation 12 in order to sustain a generally hollow cylindrically shaped support skirt 14. The longitudinal axis of the support skirt 14 coincides with the heat exchanger's longitudinal axis 11.

An annular flange 15 on the support skirt 14 is spaced from the support plate 13 and terminates the longitudinal end of the skirt. The flange 15 is welded to outer surface of the heat exchanger to enable a generally hemispherical heat exchanger closure 16 to nest within the skirt 14. A diametrical axis of the closure 16 also is general alignment with the longitudinal axis 11 of the heat exchanger 10. A pair of penetrations 17, 20 pierce the skin of the closure 16 in order to enable cylindrical sleeve 21, 22, respectively, to provide two separate feedwater inlet fittings 23, 24. The mid-portions of the sleeves 21, 22, moreover, are welded in place within the penetrations 17, 20 respectively. Illustratively, as shown in full section with respect to the fitting 24, a flanged feedwater inlet nozzle 25 outside of the hemispherical closure 16 is positioned within the support skirt 14, spaced longitudinally from the support plate 13 and spaced transversely from the longitudinal axis 11. The nozzle 25 is coupled to a generally hemispherical plenum 26 that establishes fluid communication for incoming feedwater with the interiors of an array of tubes 27 that are secured to a transversely disposed tube sheet 30 within the fitting 24. Inside the sleeve 22 the array of tubes 27 are circumscribed by means of a cylindrical shroud 31 that establishes an annular volume between the outer surface of the shroud 31 and the inner surface of the sleeve 22. A drain connection 32 provides fluid communication from this annular volume to a sodium sump (not shown) or the like as described subsequently in more complete detail. A sample connection 33 also establishes communication with this annular volume to provide a means for leak detection. The structure for the fitting 23 is similar in detail to that which was described in connection with the fitting 24.

There are, in the illustrative embodiment of the invention, two more feedwater inlet fittings that are not shown, however, because they are not in the plane of the drawing. In any event, the array of tubes 27 associated with the feedwater inlet fitting 24 and the tube array from another similar fitting that is not shown in the drawing are routed exclusively to tube bundle 34. Tube bundle 35, in contrast, is served exclusively with feedwater from an arrany of tubes 36 that are associated with the feedwater inlet fitting 23 and still another similar fitting that is not shown in the drawing.

Each individual tube in the array 36 is received in an appropriate hole 37 that is drilled in a stabilizing plate 40. The stabilizing plate 40 is further secured by means of a bolted strap 41 to a depending support bar 42 that is welded, or otherwise fixed to a radially disposed bottom support bar 43. This particular detail of construction stabilizes the tubing from vibration-induced motion and enables the individual tubes in the array 36 to protrude from the sleeve 21 for a short distance in a direction that is generally parallel to the longitudinal axis 11. There are a number of radially positioned bottom support bars with attached stabilizing plates that are not shown in the sole figure of the drawing because they are out of the plane of projection.

A sodium discharge nozzle 38 forms an end to the hemispherical closure 16 that is in alignment with the longitudinal axis 11.

The tubes in the array 36 are bent through 90° in order to pass through respective holes in the plate 40, of which the hole 37 is typical. This bend disposed the longitudinal axes of the tubes in planes that are perpendicular to the longitudinal axis 11 and parallel with the support plate 13. The segments of the tubes that are disposed in these perpendicular planes are bent in an arcuate shape through individual arcs of a circle in order to stagger the entries of these tubes into the tube bundle 35. Thus, each of the arcuate tube segments are twisted into a respective linear portion, the longitudinal axes of these linear portions being generally parallel to the longitudinal axis 11 as these portions pass the bottom support bar 43 and into the tube bundle 35.

There are a number of additional stabilizing plates, of which the plates 44, 45 and 46 are illustrative, some of the additional plates serving to support tubing from the tube array 27 and some of the plates stabilizing tubes from the tube arrays associated with the other feedwater inlet fittings that are not shown in the drawing.

Within the tube bundle 35, the individual tubes in this bundle are helically coiled, of which helical coiling of tube 47 is illustrative. It will be recalled, moreover, that all of the tubes in the bundle 35 received feedwater supply exclusively from the tube array 36 and the counterpart array that is not shown in the drawing. In any event, the central axis for the helically coiled tubes is coincident with the longitudinal axis and progresses longitudinally along the length of this axis. A generally tubular inner shroud 50 is spaced radially inward of the coiled tubes in the tube bank 35 and is concentric with these tubes. As shown in the drawing, the outer surface of the inner shroud 50 is welded to the radially inwardmost termination of the bottom support bar 43. The portion of the shroud 50 that is close to the support bar 43 has a number of apertures 51 to establish fluid communication from the tube bundle 35 to the interior of the inner shroud 50. In accordance with a characteristic of the invention, the longitudinal extent of the inner shroud 50 extends well above the last turn in the helically coiled tubes in the tube bundles 34, 35.

A tubular intermediate shroud 52 is spaced outwardly from the tube handle 35 and is concentric with the tubes in this bundle. As shown in the drawing, the end of the intermediate shroud 52 that is near to the hemispherical closure 16 is actually in the transverse plane that accommodates the first turn in the helically coiled portion of the tubing in the bundles 34, 35. The intermediate shroud 52 extends in the direction of the longitudinal axis 11 to terminate in the same transverse plane as the end of the inner shroud 50. Thus, in accordance with a feature of the invention, the intermediate shroud 52 also extends well above the plane of the last helical turn in the tubes that comprise the tube banks 34, 35.

An outer shroud 53 is spaced radially outward from the tube bundle 34 and is concentric with the tube bundles 34 and 35. The outer shroud 53 is the longest shroud of the three shrouds that are shown in the FIGURE of the drawing. Thus, the outer shroud 53 has an end that is spaced just above the initial curvature of the hemispherical closure 16, this end of the outer shroud straddling the bottom support bar 43 and being welded or otherwise suitably secured to that bar, as well as being secured to the other radially disposed bottom support bars that are out of the plane of the drawing. The other end of the outer shroud 53 extends slightly above the plane that is common to the adjacent transverse ends of the inner shroud 50 and the intermediate shroud 52. The outer shroud 53, moreover, ends in a flange 55 that is seated within an annular recess 56 formed in a transverse end of a generally cylindrical shell 57 that houses the heat exchanger structure. In this respect, the longitudinal axis of the shell 57 generally coincides with the axis 11. The inner diameter of the shell 57 is somewhat larger than the outer diameter of the outer shroud 53 in order to form an annulus 60. Spacers 61 are interposed between the shell 57 and the outer shroud 53 at spaced intervals through the length of the annulus 60.

The individual tubes in the tube bundles 34, 35 are supported throughout their entire respective lengths by means of tube support clamps that extend from radially disposed support bars mounted between the inner shroud 50 and the outer shroud 53, of which support bar 54 is typical. The tube support clamps extend down through the tube bundles 34, 35, the clamps having means for firmly engaging the outer surfaces of each pass of the horizontally coiled tubing where the tubing and the support clamp coincide. A typical structure suitable for this application is described in more complete detail in J. P. Butti U.S. patent application Ser. No. 583,330, filed June 3, 1975 for "Looped Tube Clamp Support."

As illustrated in the drawing, the individual tubes in the tube bundles 34, 35 terminate in generally linear portions 62, 63 in which the longitudinal axes of the individual tubes in each of the bundles are essentially parallel to the longitudinal axis 11.

These last portions of the steam generator tubing at the steam discharge are provided with stabilizing plate structures 64, 65, 66 and transversely disposed arcuate tube segments 67 that are similar to that which was described in connection with the feedwater inlet tube array in the hemispherical closure 16. Illustratively, the stabilizing plate structures 64, 65, 66 for the steam discharge portions of the tubes are secured to the inner surface of an hemispherical dome 70. The dome 70 is equiped with four steam outlet fittings, steam outlet fittings 71, 72 being shown in the drawing, the other two steam outlet fittings being out of the plane of the drawing's projection. In accordance with an important feature of the invention, all of the tubes from the tube bundle 34 are distributed by means of the arrangement of the arcuate tube segments 67 through only two of the four steam outlet fittings. Thus, generally linear tube array 73 from the tube bundle 34 extend in a direction that is essentially parallel with the axis 11 into the steam outlet fitting 71 to enable the ends of the individual tubes in the array to be engaged in a tube sheet 74. The tube sheet 74 is oriented in a direction that is generally transverse to the longitudinal axis 11. The tube sheet 74, moreover serves to segregate the internal portion of the dome 70 from a plenum 75 in which steam, issuing from some of the tubes in the tube bundle 34, collects before flowing through conduit 76 and valve 77 to the balance of the steam power plant (not shown). There is, of course, another similar steam outlet fitting arrangement that is out of the plane of the drawing. This second fitting that is not shown accommodates the balance of the steam discharge ends of the tubes in the tube bundle 34.

This segregation of the steam discharge portion of the tubing that is illustrative of the invention is further characterized by means of the steam outlet filling 72 and its companion fitting which also is not shown because it is out of the plane of the drawing. The internal structure of the fitting 72 and and its companion is similar to that which has been described in connection with the steam outlet fitting 71. The important difference, however, is the fact that the steam discharge fitting 72 and its companion provide a means for collecting the steam that is generated only in the tube bundle 35. Steam flow from the fitting 72 is piped through conduit 80 and a valve 81 to the plant machinery. The companion to the steam discharge fitting 72 that is not shown in the drawing is also piped to the balance of the plant through a similar conduit and valving system.

The dome 70 also accommodates two sodium inlet nozzles. Once more, because of the nature of the projection that is shown in the drawing, only sodium inlet nozzle 82 is illustrated. Continuing with the description of the nozzle 82, the structure includes an outer sleeve 83 that is secured to the dome 70 in order to provide a fluid-tight penetration of the dome for the nozzle. A reentrant conduit 84 is housed within the sleeve 83 and is spaced from the inner surface of the sleeve, thereby establishing an annular volume. Within the sleeve 83 and the conduit 84 there is a further liner 85 that guides sodium flow into a half donut-shaped manifold 86 that communicates with a number of downcomers of which downcomer 87 is shown.

To direct liquid sodium flow from the nozzle 82 only into the annular volume that is formed between the outer shroud 53 and the intermediate shroud 52 which accommodates the tube bundle 34, the downcomer is bent through two angles. These angles enable the downcomer to extend toward in a radially outward direction that also is oriented toward the support plate 13 in order to clear the open top of the intermediate shroud 52. The terminal portion of the downcomer 87 protrudes well into the annulus between the shrouds 52, 53 where it ends in a discharge opening 90.

It will be recalled that the downcomer 87 distributes sodium only to the tube bundle 34. The downcomer 87, moreover, is illustrative of several downcomers that distribute the liquid sodium from the manifold 86 to the annular volume enclosing the tube bundle. As further shown in the drawing, the sodium inlet nozzle 82 receives hot, fluid sodium from a power reactor, or the like by way of a conduit 91 that can be selectively interrupted through operation of a valve 92.

A similarly constructed sodium inlet nozzle that is out of the plane of the drawing supplies hot, fluid sodium to the annular volume that is established between the intermediate shroud 52 and the inner shroud 50. This molten sodium flows over and immerses the helically coiled tubing in the tube bundle 35. As shown in the drawing, this sodium inlet communicates with a half dounut shaped manifold 95. The manifold 95, in turn has a number of downcomers, of which downcomer 96 is typical, to maintain sodium flow over the tube bundle 35.

The dome 70 also has a penetration 93 that accommodates gas sampling apparatus for leak detection. There also is a gas connection 94 that permits argon or some other suitably inert gas to be pumped into the dome 70 for level control and monitoring purposes.

In operation, molten sodium flows into the heat exchanger 10 from a power reactor, or the like, by way of the conduit 91, the valve 92 and the sodium inlet nozzle 82. The molten sodium that enters the heat exchanger 10 through the nozzle 82 flows into the manifold 86 and is distributed by means of downcomers similar to the downcomer 87 in the annulus between the outer shroud 53 and the intermediate shroud 52 in order to immerse the coiled portions of the tubing in the tube bundle 34. The coiled tubing in the tube bundle 35 also is immersed in molten sodium that flows from the manifold 95 and through the downcomer 96, as well as the other downcomers (not illustrated) that are in fluid communication with the manifold 95, and into the annulus for the tube bundle 34. As hereinbefore mentioned, although not shown in the drawing, the molten sodium in the manifold 95 flows from a power reactor, or the like, through a conduit and a valve to a sodium inlet nozzle on the dome 70.

Preferably, the sodium levels over the two tube bundles 34, 35 are maintained between a range indicated by means of arrows 97, 100. In these circumstances, the arrow 97 that reflects the lowest desirable sodium levels over the tube bundles 34, 35 is well above the last turn in the coiled portions of these bundles. In accordance with a feature of the invention, moreover, the maximum desired sodium levels indicated by means of the arrow 100 are well below the transverse ends of the shrouds 50, 52, 53. This characteristic of the invention prevents any of the molten sodium that has been committed to either one of the two tube bundles 34, 35 by way of the separate sodium inlet nozzle and manifold constructions from flowing over to a different bundle or mingling with the sodium from that other bundle in this portion of the heat exchanger 10.

Because the longitudinal axis 11 in the illustrative embodiment of the invention under consideration is vertically oriented, the molten sodium flows through the two segregated paths parallel to the longitudinal axis 11 toward the hemispherical closure 16. Within the closure 16, both streams of molten sodium mix after discharging from the annuli formed by the shrouds 50, 52, 53. These mixed streams of molten sodium flow out of the heat exchanger 10 through the sodium discharge nozzle 38 for recirculation to the power reactor or other heat source.

In flowing over the tube bundles 34, 35 the molten sodium transfers some of its heat to the water within the tubing in each of the tube bundles 34, 35. Water enters the tubing in the bundle 34 through a path that includes feedwater conduit 101, valve 102, the feedwater inlet fitting 24, and the tube array 27. As mentioned above, feedwater also is supplied to the tube bundle 34 through another similar feedwater conduit, valve and feedwater inlet fitting structure that is out of the projection plane of the drawing.

In any event, the feedwater is supplied from these fittings exclusively to the individual tubes in the bundle 34. The water in the tube bundle 34 rises into steam through the absorption of heat from the molten sodium. Essentially half of the steam generated in the tube bundle 34 flows out of the heat exchanger 10 by way of the steam outlet fitting 71, the conduit 76 and the valve 77. The balance of the steam generated in the tube bundle 34 flows from the heat exchanger 10 through a similar steam outlet fitting, conduit and valve structure.

In a somewhat analogous manner, steam is raised in the tube bundle 35 from feedwater that is admitted to the heat exchanger 10 through a conduit 103, a valve 104, the feedwater inlet fitting 23 and the array of tubes 36. A parallel conduit, valve, inlet fitting and tube array that is not illustrated because it is out of the plane of the drawing provides the balance of the fresh feedwater that the tube bundle 35 requires.

The water in the tube bundle 35 rises into steam and about half of this steam is discharged from the heat exchanger 10 by way of the steam outlet fitting 72, the steam conduit 80 and the valve 81. As previously mentioned, another steam outlet fitting, steam conduit and valve that is out of the plane of the drawing carries off the balance of the steam that is generated in the bundle 35.

Thus, as shown, and in accordance with an important feature of the invention, two separate and discrete steam generation paths are provided within the heat exchanger 10.

In the event of a water or steam leak in one of the tube bundles products from the reaction between the water and the sodium will be registered through the leak detection gas sampling apparatus at the penetration 93. Careful examination of the individual tube bundles during a period of temporary shut-down will identify the failed bundle.

For the purpose of an illustrative example, assume that a leak is detected in the tube bundle 34. In this circumstance, the valve 92 is closed to stop sodium flow into the manifold 86 to prevent hot sodium from flowing into the tube bundle 34. To a certain extent, depending on load conditions, the sodium level changes in the annulus that accommodates the tube bundle 34. The water within the tube bundle 34 has been drained during the temporary shut down and the steam outlet valve 77 that exclusively services the tube bundle 34, along with its companion that is out of the plane of the drawing, are closed. The valve 102, along with a companion feedwater inlet valve that is not shown in the drawing which exclusively service the tube bundle 34, also are closed. In this manner, the tube bundle 34 is essentially deactivated in a manner that nevertheless enables the sound tube bundle 35 to resume to generate steam after the system is reactivated. In this way, the entire heat exchanger 10 need not be taken out of service prior to a regularly scheduled deactivation for inspection and maintenance. The overall capital costs are lower for equipment of the type that characterizes the invention, in contrast with those systems that have been proposed with a number of small, individual heat exchangers.

Naturally, if a leak is discovered in the tube bundle 35, steam can be generated in the tube bundle 34, and the tube bundle 35 deactivated through closing the appropriate sodium inlet, feedwater inlet and steam discharge valves.

If preferred, more than the illustrated two discrete bundles of tubes can be used to divide even further the steam generating capacity into three or more segregated tube bundles. The number of steam generating paths also can differ from the number of independent sodium feed paths by some multiple. Typically in this respect, there could be two independent sodium feed paths and four separate steam generating circuits. In these circumstances, two of the three intermediate shrouds might extend only to the level of the top of the tube supports. The central shroud, however, would extend into the inert gas space above the sodium level. Although this further embodiment of the invention has only as many truly parallel steam generation paths as the number of parallel sodium loops—in this instance, two steam generation paths—the additional shrouds confine sodium-water reaction damage to a single one of these circuits.

The embodiments of the invention in which an exclusive property or privilege is claimed are defined as follows:

1. An heat exchanger comprising a shell, a closure on one end of said shell for establishing a gas space within the heat exchanger, a plurality of shrouds mounted within the heat exchanger, at least one of said shrouds extending from said shell and into said gas space, said shrouds being spaced from each other and from said shell, a plurality of separate tube bundles, each of said tube bundles being mounted within said shell and between said shrouds, a plurality of valves each of said individual valves selectively establishing fluid communication through a respective one of said tube bundles, at least two inlet nozzles penetrating the heat exchanger, each of said nozzles establishing separate fluid communication with the exterior of a respective one of said tube bundles, and a plurality of inlet nozzle valves, each of said valves selectively establishing fluid communication with said respective tube bundle exteriors.

2. An heat exchanger according to claim 1 wherein all of said shrouds extend from said shell into said gas space.

3. An heat exchanger according to claim 1 wherein the tubes in each of said tube bundles is helically coiled through a portion of the length of said tube bundles.

4. An heat exchanger according to claim 1 wherein said closure has at least one aperture formed therein for sampling gas in said gas space.

* * * * *

UNITED STATES PATENT AND TRADEMARK OFFICE

CERTIFICATE OF CORRECTION

PATENT NO. : 4,163,470

DATED : August 7, 1979

INVENTOR(S) : Arne A. Johnsen and Chandrasekhara R. Kakarala

It is certified that error appears in the above-identified patent and that said Letters Patent are hereby corrected as shown below:

Column 4 - Line 15 - "handle" should be --bundle--

Column 5 - Line 12 - "equiped" should be --equipped--

Signed and Sealed this

*Eleventh* Day of *March 1980*

[SEAL]

*Attest:*

SIDNEY A. DIAMOND

*Attesting Officer*

*Commissioner of Patents and Trademarks*